US010700407B2

(12) United States Patent
Cousin et al.

(10) Patent No.: US 10,700,407 B2
(45) Date of Patent: Jun. 30, 2020

(54) ACQUISITION AID ANTENNA DEVICE AND ASSOCIATED ANTENNA SYSTEM FOR MONITORING A MOVING TARGET

(71) Applicant: Zodiac Data Systems, Courtaboeuf (FR)

(72) Inventors: Pascal Cousin, Carpiquet (FR); Christophe Melle, Gujan-Mestras (FR); Alain Karas, Le Plessis Bouchard (FR)

(73) Assignee: Zodiac Data Systems (FR)

( * ) Notice: Subject to any disclaimer, the term of this patent is extended or adjusted under 35 U.S.C. 154(b) by 278 days.

(21) Appl. No.: 15/769,574

(22) PCT Filed: Oct. 21, 2016

(86) PCT No.: PCT/EP2016/075454

§ 371 (c)(1),
(2) Date: Apr. 19, 2018

(87) PCT Pub. No.: WO2017/068155

PCT Pub. Date: Apr. 27, 2017

(65) Prior Publication Data

US 2018/0358682 A1 Dec. 13, 2018

(30) Foreign Application Priority Data

Oct. 22, 2015 (FR) ..... 15 60104

(51) Int. Cl.
*H01Q 19/06* (2006.01)
*H01Q 1/12* (2006.01)
(Continued)

(52) U.S. Cl.
CPC ..... *H01Q 1/125* (2013.01); *H01Q 1/36* (2013.01); *H01Q 5/28* (2015.01); *H01Q 5/30* (2015.01);
(Continued)

(58) Field of Classification Search
CPC ..... H01Q 1/125; H01Q 5/28; H01Q 25/002; H01Q 21/30; H01Q 15/08; H01Q 15/16;
(Continued)

(56) References Cited

U.S. PATENT DOCUMENTS 2,422,184 A * 6/1947 Cutler ..... G01S 1/02 343/779
2,761,141 A 8/1956 Strandberg et al.
(Continued)

OTHER PUBLICATIONS

HR-76 https://www.radartutorial.eu/19.kartei/11.ancient/karte193.en.html (Year: 2019).*
(Continued)

*Primary Examiner* — Daniel Munoz
*Assistant Examiner* — Bamidele A Jegede
(74) *Attorney, Agent, or Firm* — Lerner, David, Littenberg, Krumholz & Mentlik, LLP

(57) ABSTRACT

The invention concerns an acquisition aid antenna device (3), intended to be secured to a main antenna device, the acquisition aid antenna device (3) comprising: —a multi-band acquisition aid antenna feed (7), suitable for receiving radiation emitted by a target, and—a lens (9) arranged in the main reception lobe of the acquisition aid antenna feed (7) for concentrating the radiation received from the target towards the acquisition aid antenna feed (7). This device makes it possible to detect targets that are outside the useful beam of the main antenna device, and to use an acquisition aid antenna feed identical to the feed of the main antenna device.

9 Claims, 4 Drawing Sheets

Figure 1:
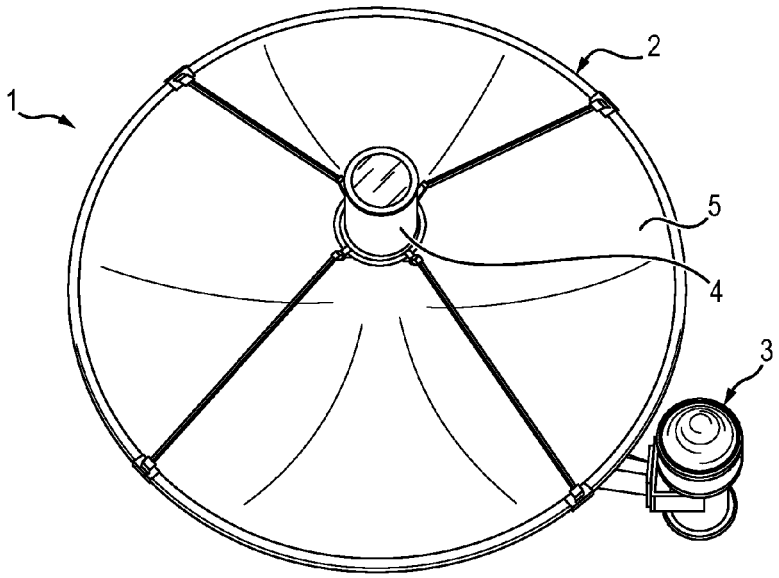

(51) Int. Cl.

| | |
|---|---|
| ***H01Q 15/08*** | (2006.01) |
| ***H01Q 21/30*** | (2006.01) |
| ***H01Q 25/00*** | (2006.01) |
| ***H01Q 5/28*** | (2015.01) |
| ***H01Q 5/30*** | (2015.01) |
| ***H01Q 1/36*** | (2006.01) |
| ***H01Q 15/16*** | (2006.01) |

(52) U.S. Cl.
CPC ..... *H01Q 15/08* (2013.01); *H01Q 15/16* (2013.01); *H01Q 19/062* (2013.01); *H01Q 21/30* (2013.01); *H01Q 25/002* (2013.01)

(58) Field of Classification Search
CPC ..... H01Q 1/36; H01Q 5/30; H01Q 19/062; G01S 1/02; G01S 13/951; G01S 13/87; G01S 7/024; G01S 13/00; G01S 15/00; G01S 17/00; G01S 7/03; G01S 13/95; G01S 13/02; G01S 7/288; G01S 13/931; G01S 13/04; G01S 2013/0254; G01S 13/48; G01S 13/4463; G01S 13/66; G01S 13/86; G01S 17/87; G01S 3/786; Y02A 90/18; F41G 7/008; F41G 7/2293; F41G 7/2286; F41G 7/2253
See application file for complete search history.

(56) References Cited

U.S. PATENT DOCUMENTS 2,825,900 A * 3/1958 Collbohm ..... H01Q 19/175 342/380
2,956,279 A * 10/1960 Bartholoma ..... H01Q 3/02 343/758
2,972,743 A * 2/1961 Svensson ..... H01Q 15/0013 343/838
3,026,517 A * 3/1962 Nameth ..... G01S 1/02 343/758
3,028,595 A * 4/1962 Cole ..... H01Q 25/00 342/359
3,114,149 A * 12/1963 Jessen, Jr. ..... G01S 17/87 343/720
3,170,158 A * 2/1965 Rotman ..... H01Q 3/46 342/376
3,384,890 A * 5/1968 List ..... G01S 1/02 342/147
4,096,482 A 6/1978 Walters
5,117,240 A * 5/1992 Anderson ..... H01Q 13/0275 343/786
5,166,698 A * 11/1992 Ashbaugh ..... H01Q 13/025 343/783
5,307,077 A * 4/1994 Branigan ..... G01S 13/4463 342/53
6,023,246 A * 2/2000 Tanabe ..... H01Q 19/08 343/753
6,590,544 B1 * 7/2003 Filipovic ..... H01Q 15/08 343/700 MS
6,771,218 B1 * 8/2004 Lalezari ..... G01S 13/48 342/373
6,967,627 B2 * 11/2005 Bhattacharyya ..... H01Q 13/025 343/786
7,671,785 B1 * 3/2010 Walker ..... G01S 7/024 342/26 D
7,719,458 B1 * 5/2010 Walker ..... G01S 7/024 342/26 D
9,865,921 B2 * 1/2018 Griffith ..... G02B 6/4225
2005/0007287 A1 * 1/2005 Balaji ..... H01Q 13/025 343/772
2005/0007289 A1 * 1/2005 Zarro ..... H01Q 13/02 343/786
2008/0084357 A1 * 4/2008 Smeltzer ..... H01Q 3/02 343/757
2010/0013726 A1 1/2010 Matthews et al.
2012/0098727 A1 * 4/2012 Vion ..... H01Q 1/125 343/840
2012/0105293 A1 * 5/2012 Hsu ..... H01Q 13/02 343/786
2014/0009330 A1 * 1/2014 Knight ..... G01S 13/95 342/26 R
2014/0285373 A1 * 9/2014 Kuwahara ..... G01S 13/931 342/27
2015/0002357 A1 * 1/2015 Sanford ..... H01Q 1/525 343/836

OTHER PUBLICATIONS

RTN-30X "Orion" https://www.radartutorial.eu/19.kartei/07.naval/karte079.en.html (Year: 2018).*
ST801 https://www.radartutorial.eu/19.kartei/11.ancient/karte195.en.html (Year: 2019).*
Preliminary French Search Report for FR1560104 dated Sep. 5, 2016.
International Search Report for WO2017068155 (Application No. PCT/EP2016/075454) dated Jan. 10, 2017.
Migl et al., "X-Band Acquisition Aid Antenna for Ground Stations Applications," Antennas and Propagation (EUCAP), 2010, Proceedings of the Fourth European Conference, IEEE, Piscataway, NJ, USA, Apr. 12, 2010, pp. 1-5.

* cited by examiner

ACQUISITION AID ANTENNA DEVICE AND ASSOCIATED ANTENNA SYSTEM FOR MONITORING A MOVING TARGET

CROSS REFERENCE TO RELATED APPLICATIONS

The present application is a national phase entry under 35 U.S.C. § 371 of International Application No. PCT/EP2016/075454, filed Oct. 21, 2016, published in French, which claims priority from French Patent Application No. 1560104, filed Oct. 22, 2015, the disclosures of which are incorporated by reference herein.

FIELD OF THE INVENTION

The invention relates to an acquisition aid antenna device and an antenna system for monitoring a moving target including such an acquisition aid device.

The invention applies to monitoring and tracking stations, for telemetry and test flights for craft or aircraft (planes, missiles, drones . . . ) or in the spatial domain as receipt of data from scientific and observation payloads (low-orbiting satellites), orbit control during the launch phase for all types of satellites (LEO, MEO, GEO), as well as for antenna systems on the ground or on board warships or civil ships, aerial defence systems, monopulse and multiband radar systems.

PRIOR ART

In a telemetry station, the main antenna is particularly directive with a fine emission beam, having an aperture angle of a few degrees. Given the fineness of its beam, it is difficult to point the main antenna towards the target, in particular when the latter is moving swiftly.

Acquisition aid antennas are auxiliary antennas intended to be fixed to main antennas in a telemetry station.

This acquisition aid antenna is generally attached to the main antenna and has a lobe clearly wider than that of the main antenna (between 15 and 30°, or up to 20 times that of the main antenna). The role of the acquisition aid antenna is to facilitate rapid acquisition and ensure short-distance tracking. Once the main antenna is correctly oriented and the level of the received signal originating from the target is sufficient to allow reception by the main antenna, the signal is switched to the main antenna, without loss of tracking when the target is at proper distance.

The acquisition aid antenna is also used to retrieve telemetry data in case of signal loss by the main antenna. The acquisition aid antenna in particular continues to track a moving target (drone, plane or missile for example) when the target is near or is moving swiftly.

It is thus possible to switch between the main antenna and the acquisition aid antenna to maintain continuity of the telemetry signal.

Switching the main antenna to the acquisition aid antenna can also be done preventively when the proximity of the target risks causing saturation of radiofrequency equipment.

Acquisition aid antennas are known, comprising an antenna source and a small-diameter parabolic reflector, the antenna source being disposed at the focus of the reflector. A drawback to this type of antenna is that because the reflector is small in diameter, the antenna source masks a substantial part of the reflector. The consequence here is that the acquisition aid antenna has a poor yield and a low-quality reception diagram (presenting secondary lobes of high amplitude).

Acquisition aid antennas comprising a planar array of radiating elements are also known. But the bandwidth of the array is limited, which can result in the use of several arrays in parallel to obtain multiband reception and impacts costs and bulk of the acquisition aid antenna.

SUMMARY OF THE INVENTION

An aim of the invention is to propose an antenna system including an acquisition aid antenna which has reduced bulk and performs well in terms of yield and quality of the radiation diagram.

This aim is attained within the scope of the present invention by way of an antenna system for monitoring a moving target, comprising:

- a main antenna device comprising:
  - a parabolic reflector capable of reflecting radiation emitted by a target according to a first reception diagram having a main reception lobe having a first aperture angle,
  - a main antenna source capable of receiving the radiation reflected by the parabolic reflector, and
- un acquisition aid antenna device fixedly mounted relative to the main antenna device, comprising:
  - a multiband acquisition aid antenna source, capable of receiving radiation emitted by a target according to a second reception diagram having a main reception lobe having a second aperture angle, and
  - a lens disposed in the main reception lobe of the acquisition aid antenna source for concentrating the radiation received from the target to the antenna source, so as to receive the radiation emitted by the target according to a third reception diagram having a main reception lobe having a third aperture angle less than the second aperture angle and greater than the first aperture angle.

Because a lens is used, the proposed acquisition aid antenna device concentrates radiation from the target onto the antenna source and has reduced bulk. The diameter of the device can be in the order of 1.5 to 5 wavelengths, which places the acquisition aid antenna device to the side of the larger-diameter main antenna device.

The use of a lens disposed in the main reception lobe of the acquisition aid antenna source adjusts the aperture angle of the acquisition aid antenna device and produces good yield while presenting reduced bulk.

The proposed system in particular uses an acquisition aid antenna source identical to that for the main antenna device.

The proposed system can further have the following characteristics:

- the lens reduces the aperture angle of the main lobe of the acquisition aid antenna source by a third angle/second angle quotient between 1/6.5 and 1/3.25,
- the acquisition aid antenna source comprises several radiating assemblies, each radiating assembly being capable of receiving radiation in a given frequency band, different to the frequency bands received by the other radiating assemblies, and in which the radiating assembly in the lowest frequency range has a phase center located at the focus of the lens,
- the other radiating assemblies have phase centers located on an optical axis of the lens while being offset relative to the focus of the lens, the radiating elements are disposed such that the higher the frequency range of a radiating element, the closer the phase center of the radiating element is to the lens, the lens is configured to transform an almost-planar wave received from the target into a spherical wave, the spherical wave being transmitted towards the acquisition aid antenna source, the lens is formed in at least one block of material, the material having a density between 1.05 and 1.15, and a relative permittivity (or dielectric constant) between 2.5 and 2.7, the material forming the lens is a polymer material, preferably a polystyrene-based material, the main antenna source and the acquisition aid antenna source are identical to each other.

PRESENTATION OF THE DRAWINGS

Figure 2:
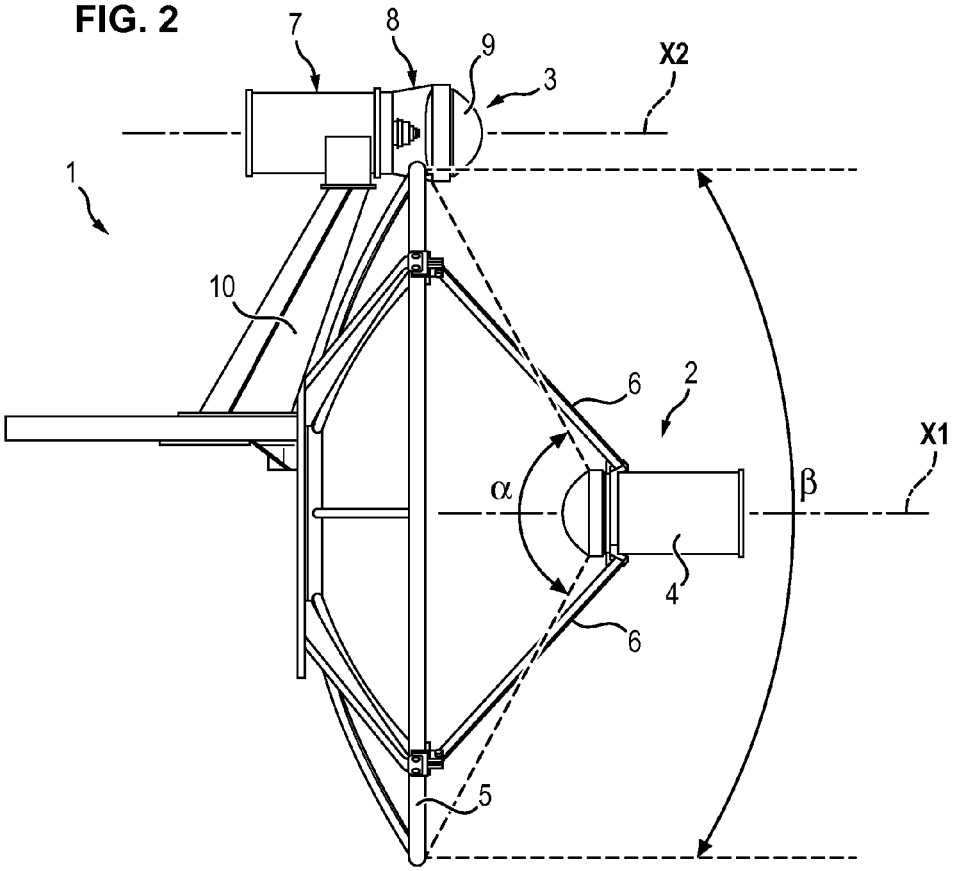
Figure 3:
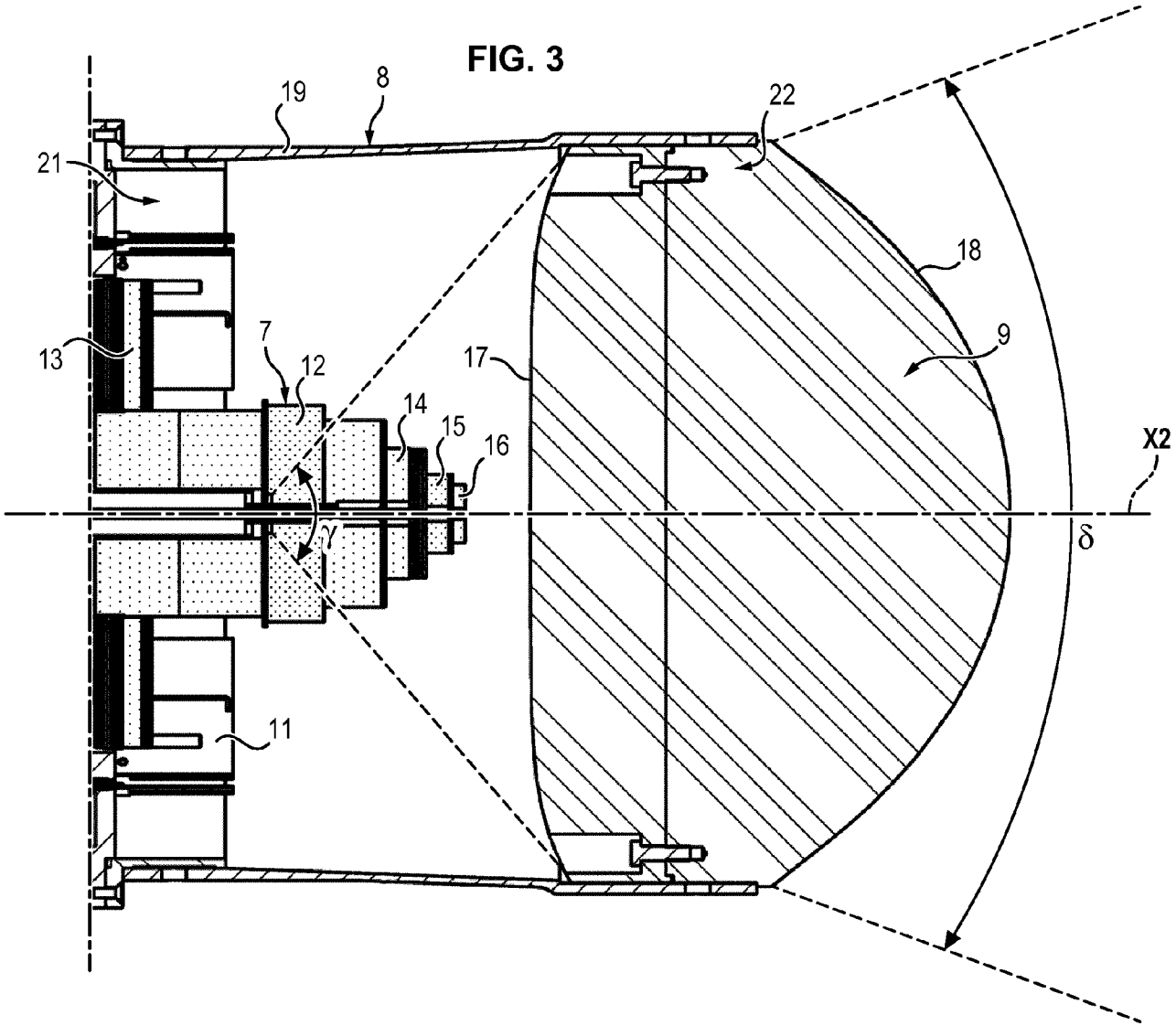
Figure 4:
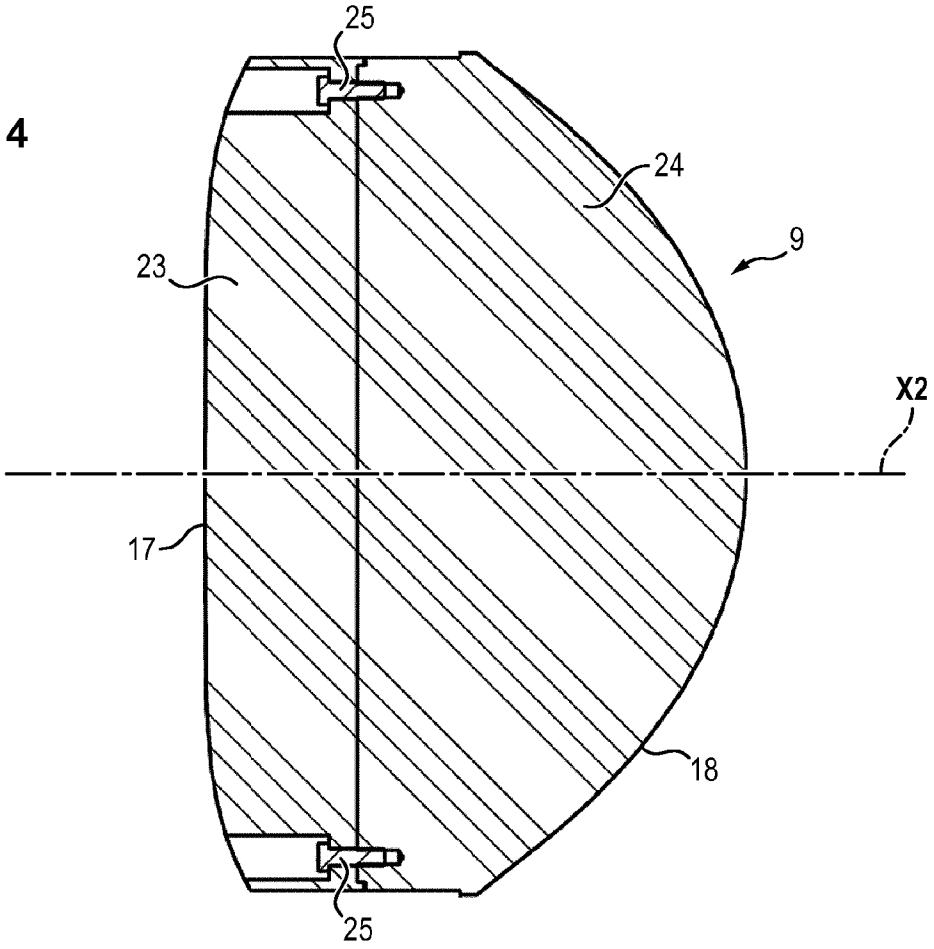
Figure 5:
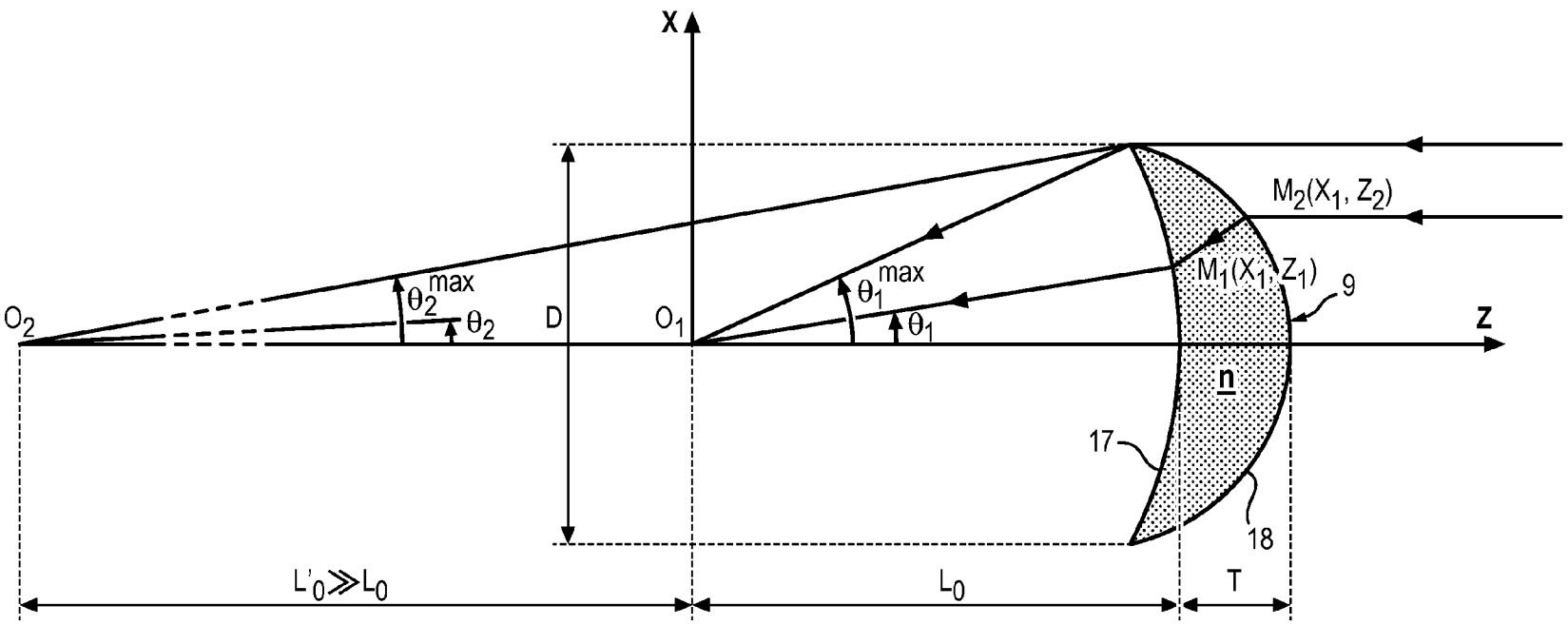

Other characteristics and advantages will emerge from the following description which is purely illustrative and non-limiting and must be viewed with respect to the appended figures, in which:

FIGS. 1 and 2 schematically illustrate an antenna system for monitoring a moving target, in accordance with an embodiment of the invention, FIG. 3 schematically illustrates an acquisition aid antenna device in longitudinal section, FIG. 4 schematically illustrates a lens of the acquisition aid device in longitudinal section, FIG. 5 schematically illustrates the settings of the lens of the acquisition aid antenna device.

DETAILED DESCRIPTION OF AN EMBODIMENT

In FIG. 1, the antenna system 1 shown comprises a main antenna device 2 and an associated auxiliary antenna device 3.

The main antenna device 2 comprises a main antenna source 4 and a parabolic reflector 5. The main antenna source 4 is positioned at the focus of the parabolic reflector 5. The main antenna source 4 is kept in this position by a support 6 for fixing the main antenna source 4 to the parabolic reflector 5.

The main antenna source 4 can be a multiband source, for example a multiband source such as described in document FR 3 007 215. Such a source is capable of transmitting and/or receiving telemetry signals selectively in each of the frequency bands L (1 GHz to 2 GHz), S (2 GHz to 4 GHz) and C (4 GHz to 8 GHz).

The main antenna source 4 is capable of lighting the parabolic reflector 5 with an aperture angle at −10 dB $\alpha$ of about 70 degrees around the main reception axis X1 of the source 4. In this way, the main antenna source 4 substantially lights the entire reflecting surface of the parabolic reflector 5.

The parabolic reflector 5 is capable of reflecting radiation emitted by a target towards the source 4 with an aperture angle at −10 dB $\beta$ between 2 and 8 degrees.

The auxiliary antenna device 3 (called "acquisition aid antenna device") is disposed next to the main antenna device 2. The acquisition aid antenna device 3 is fixedly mounted on the main antenna device 2. In this way, during monitoring of a moving target, the two devices 2 and 3 are driven in unison, according to identical displacement.

The acquisition aid antenna device 3 comprises an acquisition aid antenna source 7, a lens support 8 and a lens 9.

The antenna system 1 also comprises a support arm 10 connecting the acquisition aid antenna device 3 to the main antenna device 2. The support arm 10 is fixed on the one hand to the parabolic reflector 5 of the main antenna device 2 and on the other hand to the casing of the acquisition aid antenna source 7. The support arm 10 keeps the acquisition aid antenna device 3 in a fixed position relative to the main antenna device 2. In this way, during acquisition of telemetry signals, the acquisition aid antenna device 3 and the main antenna device 2 are moved simultaneously, identically.

In the embodiment illustrated in FIGS. 1 and 2, the acquisition aid antenna source 7 is identical to the main antenna source 4.

This characteristic has the advantage of not needing specific development for the acquisition aid antenna source. In this way, the acquisition aid source has the same characteristics of frequency bands, polarization and diagrams (sum and difference) as the main antenna source. Also, in case of breakdown of the main antenna source, the acquisition aid antenna source can be used provisionally as main antenna source.

The acquisition aid antenna device is illustrated more precisely in FIG. 3.

The acquisition aid antenna source 7 has a main reception axis X2, parallel to the main reception axis X1 of the main antenna source.

The acquisition aid antenna source 7 comprises a plurality of radiating assemblies 11 to 16 capable of generating radiation respectively in the frequency bands C, S and L. Each radiating assembly 11 to 16 is capable of receiving radiation according to a first reception diagram having a main reception lobe oriented along the main reception axis X2.

More precisely, the radiating assemblies comprise:

a first delta radiating assembly 11 capable of receiving delta radiation in the first frequency band L, a first sigma radiating assembly 12 capable of receiving sigma radiation in the first frequency band L, a second delta radiating assembly 13 capable of receiving delta radiation in the second frequency band S, a second sigma radiating assembly 14 capable of receiving sigma radiation in the second frequency band S, a third delta radiating assembly 15 capable of receiving delta radiation in the third frequency band C, and a third sigma radiating assembly 16 capable of receiving sigma radiation in the third frequency band C.

In each of the frequency bands L, S and C, the main reception lobe has an aperture angle $\gamma$. Aperture angle $\gamma$ designates the aperture angle of the acquisition aid antenna source 7 alone, without the lens 9. The aperture angle $\gamma$ is about 130 degrees at −10 dB.

The lens 9 is positioned on the main reception axis X2 of the acquisition aid antenna source 7, the optical axis of the lens 9 being combined with the main reception axis of the source 7. The lens 9 is disposed relative to the acquisition aid antenna source 7 such that the source receives all the radiation transmitted by the lens.

The lens 9 is a convergent lens presenting a first convex surface 17 (also called "inner surface") and a second convex surface 18 (also called "outer surface"), opposite the first convex surface 17. The first convex surface 17 is directed towards the source 7. The second convex surface 18 is directed towards a target to be detected. The lens 9 is configured to concentrate radiation emitted by the target towards the acquisition aid antenna source 7 so as to produce a reception diagram of the acquisition aid antenna device having a main reception lobe having an aperture angle δ less than the aperture angle γ.

More precisely, the lens 9 is dimensioned to reduce the aperture angle of the main lobe with a δ/γ quotient between 1/6.5 and 1/3.25. The angle δ is therefore between 20 and 40 degrees at −10 dB (as a function of the considered frequency band).

The lens support 8 fixedly mounts the lens 9 relative to the acquisition aid antenna source 7. The lens support 8 has a general tubular form. The lens support 8 comprises a wall 19 of rotationally symmetrical general form defining a first opening 21 and a second opening 22. The lens support 8 is fixed both to the acquisition aid source 7, the source extending through the first opening 21, and also to the lens 9, the lens 9 obstructing the second opening 22.

The lens 9 has a focus which is a point. The radiating assembly in the lowest frequency range (in this case, the assembly 12 radiating in band L) has its phase center located at the focus of the lens 9. However, the radiating assemblies in the other frequency ranges (in this case, assemblies 14 and 16 radiating in bands S and C) have phase centers located on the optical axis of the lens 9 by being offset relative to the focus of the lens 9. The radiating assemblies 12, 14 and 16 are disposed such that the higher the frequency range of a radiating assembly, the further away the phase center of the radiating assembly is from the focus of the lens 9 and near the first surface 17 of the lens 9. In this way, the phase centers of the radiating elements in the highest frequency ranges (in this case, the assemblies 14 and 16 radiating in the S and C bands) are located between the focus of the lens 9 and the lens 9.

By controlling the position of the phase centers of the radiating assemblies 12, 14 and 16 relative to the focus of the lens 9, it is possible to adjust the aperture angle δ, for each of the frequency range L, S and C, on a passband of 2 octaves. In particular, the radiating assemblies 12, 14 and 16 can be disposed along the optical axis of the lens so as to minimize variation in the aperture angle δ as a function of the reception frequency range L, S and C.

The lens 9 is dimensioned to transform an almost-planar wave received from the target in a spherical wave, the spherical wave being transmitted towards the antenna source 7, in the lowest frequency range (in this case, the band L).

As illustrated in FIGS. 3 and 4, the lens 9 can be formed by machining in one or more blocks of material. The material used preferably has a density between 1.05 and 1.15, and relative permittivity between 2.5 and 2.7.

The material forming the lens 9 is a dielectric material such as a polymer material, having low dielectric losses (loss tangent <0.0007 to 10 GHz) in the reception frequency ranges of the acquisition aid source and a refraction index greater than 1.5. The polymer material can be a polystyrene- and hydrocarbon-based material. An example of appropriate material is material sold as Rexolite® by the company San Diego Plastics, Inc., produced by crosslinking of polystyrene with divinylbenzene.

However, other polymer materials could be used, such as expanded polytetrafluoroethylene for example.

In the example illustrated in FIGS. 3 and 4, the lens 9 is formed from two pieces of material 23 and 24. The two pieces 23 and 24 are joined together by means of screws 25. It is possible to make each piece 23, 24 independently of each other, and in particular to machine each convex surface 17 and 18 separately FIG. 5 schematically illustrates the settings of the lens for calculating the equations of the surfaces 17 and 18 of the lens.

The following parameters are defined:

D: diameter of the lens, $O_1$: focus of the lens, $O_2$: calculation point at almost-infinite distance (considerable relative to the distance $L_0$), $L_0$: distance between the focus $O_1$ and the first convex surface 17, $L_0'$: distance between the point $O_2$ and the first convex surface 17 ($L_0'$ is an arbitrary distance far greater than the distance $L_0$, for example $L'_0 \sim 10000 \times L_0$), T: thickness of the lens, $\theta_1^{max}$: maximum focus angle, by the lens, of rays at the focus $O_1$ of the lens, $\theta_2^{max}$: maximum focus angle, by the lens, of rays at the point $O_2$, $T_{1dB}$: level of the incident wave field at the edge of the lens, $T_{2dB}$: level of the refracted wave field at the edge of the lens, n: index of the material forming the lens.

For obtaining a maximum gain, the following two conditions must be satisfied:

1/ the lens is collimating, i.e., the parallel incident rays are focused on the source, implying that $|L_0'| \gg |L_0|$ and $L'_0 \sim 10000 \times L_0$, 2/ the amplitude distribution of the electromagnetic field in the radiating opening at the input of the lens is as uniform as possible, implying that $T_{2dB}(\theta_2^{max}) \approx 0$ dB.

A point $M_1$, of coordinates $(x_1, z_1)$, is defined as a point of intersection of a ray with the first surface 17 of the lens, and a point $M_2$, of coordinates $(x_2, z_2)$, a point of intersection of the same ray with the second surface 18 of the lens.

The coordinates of points $M_1$ and $M_2$ verify the following differential equation:

$$\frac{dz_1}{dx_1} = \frac{x_1\sqrt{(x_2-x_1)^2+(z_1-z_2)^2} - n(x_2-x_1)\sqrt{x_1^2+z_1^2}}{n(z_2-z_1)\sqrt{(x_1^2+z_1^2)} - z_1\sqrt{(x_2-x_1)^2+(z_2-z_1)^2}}$$

$$r_1 = \sqrt{x_1^2+z_1^2}$$

$$\cos(\theta_1) = \frac{z_1}{r_1}$$

$$\cos(\theta_2) = \left\{1 - [1-\cos^{2a+1}(\theta_1)] \times \frac{1-\cos^{2b+1}(\theta_2^{max})}{1-\cos^{2a+1}(\theta_1^{max})}\right\}^{\frac{1}{2b+1}}$$

In which a and b are exponents of the cos(θ) laws of illumination:

$$a = -\frac{T_{1dB}}{20\log(\cos\theta_1^{max})}$$

$$b = -\frac{T_{2dB}}{20\log(\cos\theta_2^{max})}$$

with $T_{1dB} = -10$ dB and $T_{2dB} = -0.0001$ dB $$\sin(\theta_2) = \sqrt{1-[\cos(\theta_2)]^2}$$

$$\tan(\theta_2) = \frac{\sqrt{1-[\cos(\theta_2)]^2}}{\cos(\theta_2)}$$

$$a_0 = \frac{[(n-1)\times T + L_0 - r_1]}{n}$$

-continued $$a_1 = \frac{1}{n \times \sin(\theta_2)}$$

$$a_2 = \frac{1}{[\sin(\theta_2)]^2} \times \left[1 - \frac{1}{n^2}\right]$$

$$a_3 = \frac{L_0' - z_1}{\tan(\theta_2)} - x_1 - a_0 \cdot a_1$$

$$a_4 = (L_0' - z_1)^2 - a_0^2 + x_1^2$$

$$\Delta = a_3^2 - a_2 \cdot a_4$$

$$x_2 = \frac{-a_3 + \sqrt{\Delta}}{a_2}$$

$$z_2 = L_0' + \frac{x_2}{\tan(\theta_2)}$$

With the following initial conditions:

$x_1=0$ and $z_1=L_0$ $x_2=0$ and $z_2=L_0+T$

Resolution of the differential equation can be achieved by a Runge Kutta method, of order 4.

Resolution of the differential equation leads to finding two series of points $M_1$ and $M_2$ (each point being defined by its coordinates $(x_1, z_1)$ and $(x_2, z_2)$) of the first surface 17 and of the second surface 18 of the lens.

From each series of points, it is possible to calculate an equation of the corresponding surface of the lens. The equation of the surface can be calculated in the form of a polynomial, by interpolation of the series of points.

The lens is thus specifically configured to have a focal distance adjusted to the different phase centers of each sub-band of the source, which allows reaching an excellent yield at even the lowest frequencies. The diameter of the acquisition aid antenna is now minimized, as is its weight.

For example, a lens of 30 to 40 centimeters in diameter can simultaneously cover bands L, S and C of the telemetry with the proper aperture angle and reduced secondary lobes.

The use of a lens disposed in the reception beam of the acquisition aid antenna source allows adjusting the aperture angle of the acquisition aid antenna device and produces a proper yield with reduced bulk.

The multiband source based on differentiated radiating elements is a solution which confers good merit factors on the main antenna.

The proposed system uses an acquisition aid antenna source identical to the main antenna source. Reuse of the main acquisition antenna source simplifies the conception and maintenance of the antenna system, even if it remains possible to use different sources.

The topology of the tracking device is identical for both antennas.

The invention claimed is:

1. An antenna system for monitoring a moving target, comprising: a main antenna device comprising:

a parabolic reflector capable of reflecting radiation emitted by a target according to a first reception diagram having a first main reception lobe having a first aperture angle, a main antenna source capable of receiving the radiation reflected by the parabolic reflector, and an acquisition aid antenna device fixedly mounted relative to the main antenna device, comprising:

a multiband acquisition aid antenna source, capable of receiving radiation emitted by the target according to a second reception diagram having a second main reception lobe having a second aperture angle, and a lens disposed in the second main reception lobe of the acquisition aid antenna source for concentrating the radiation received from the target to the acquisition aid antenna source, so as to receive the radiation emitted by the target according to a third reception diagram having a third main reception lobe having a third aperture angle less than the second aperture angle and greater than the first aperture angle.

2. The system according to claim 1, wherein the lens reduces the second aperture angle of the second main reception lobe of the acquisition aid antenna source by a third angle/second angle quotient between 1/3.25 and 1/6.5.

3. The system according to claim 1, wherein the acquisition aid antenna source comprises several radiating assemblies, each radiating assembly being capable of receiving radiation in a given frequency band, and wherein the radiating assembly in the lowest frequency range has a phase center located at the focus of the lens.

4. The system according to claim 3, wherein the other radiating assemblies have phase centers located on an optical axis of the lens by being offset relative to the focus of the lens.

5. The system according to claim 4, wherein the radiating elements are disposed such that the higher the frequency range of a radiating element, the closer the phase center of the radiating element is to the lens.

6. The system according to claim 1, wherein the lens is configured to transform an almost planar wave received from the target into a spherical wave, the spherical wave being transmitted towards the acquisition aid antenna source.

7. The system according to claim 1, wherein the lens is formed in at least one block of material, the material having a density between 1.05 and 1.15, and relative permittivity between 2.5 and 2.7.

8. The system according to claim 7, wherein the material forming the lens is a polymer material, preferably a polystyrene based material.

9. The system according to claim 1, wherein the main antenna source and the acquisition aid antenna source are identical to each other.

* * * * *